United States Patent [19]

Thomas

[11] Patent Number: 4,515,501

[45] Date of Patent: May 7, 1985

[54] TUNNEL LININGS

[75] Inventor: Norman S. Thomas, Drayton, England

[73] Assignee: Fairclough Civil Engineering Limited, London, England

[21] Appl. No.: 408,574

[22] Filed: Aug. 16, 1982

[30] Foreign Application Priority Data

Dec. 15, 1981 [GB] United Kingdom ..... 8137819

[51] Int. Cl.[3] ..... E21D 11/08

[52] U.S. Cl. ..... 405/153; 52/584; 405/151

[58] Field of Search ..... 405/150, 151, 152, 153; 52/582, 584

[56] References Cited

U.S. PATENT DOCUMENTS 3,928,951 12/1975 Murphy ..... 52/584 X
4,004,391 1/1977 Keeton ..... 52/584
4,104,885 8/1978 Thomas ..... 405/153
4,318,636 3/1982 Thomas ..... 405/153

FOREIGN PATENT DOCUMENTS 1585770 3/1981 United Kingdom ..... 405/153

*Primary Examiner*—David H. Corbin
*Attorney, Agent, or Firm*—Karl W. Flocks; Sheridan Neimark; A. Fred Starobin

[57] ABSTRACT

Arcuate concrete segments of a tunnel lining are joined together by means of a recess in a segment edge having a pair of abutment members projecting into the recess to define a constriction therein, the abutment members forming a pair of abutment surfaces facing inwardly of the constriction, and a screw-threaded headed bolt in an adjacent segment, the segments being positioned edge to edge with the bolt inserted in the recess and moved relatively to each other so that the bolt head engages the abutment surfaces. The recess is accessible from inside the lining to allow the bolt head to be tightened.

12 Claims, 18 Drawing Figures

TUNNEL LININGS

This invention relates to a method of joining together segments of a tunnel lining and to arcuate segments suitable for use in this method.

Tunnels intended to serve as ducts for sewage effluent or other fluids are commonly lined with concrete segments to render the tunnel watertight. The lining may consist of arcuate segments arranged end-to-end to form annuli, the annuli being placed side-by-side to form a continuous lining. The lining preferably has a smooth inside surface. The lining may be required to withstand considerable interior fluid pressure.

The present invention is intended to provide a method of assembling such a lining which may be carried out entirely from within the tunnel, is simple and is capable of giving a strong watertight lining. The term "tunnel" used herein includes both horizontal and inclined tunnels, including vertical tunnels commonly described as "shafts".

According to one aspect of the invention, there is provided a method of joining together arcuate concrete segments of a tunnel lining, the edge of one segment being provided with a recess and a pair of abutment members projecting into the recess to define a constriction therein, the abutment members forming a pair of abutment surfaces facing inwardly of the constriction and the edge of an adjacent segment being provided with a screw-threaded headed bolt projecting beyond the edge of the adjacent segment, in which the segments are positioned edge to edge with the bolt of the adjacent segment inserted into the recess and the adjacent segment is moved relative to said one segment so that the bolt is moved to within the constriction, the recess being accessible from the inside of the tunnel to allow tightening of the bolt head against the abutment surfaces.

The invention also relates to segments for use in such a method.

The screw-threaded headed bolt may be mounted in a screw-threaded socket in the edge of the adjacent segment and be tightened by screwing into the socket so that the head, preferably provided with a washer, is tightened against the abutment surfaces of the constriction. Alternatively, the bolt may be rigidly mounted in the edge, the projecting part of the bolt being screw-threaded, and the head comprise a nut which is tightened by screwing along the bolt.

The abutment members may comprise a pair of inserts cast into the concrete or, when the recess is in an edge to engage the edge of an adjacent segment of the same annulus, the pair of abutment members may be formed as a single plate having an aperture of which a narrower part forms the constriction.

Figure 1:
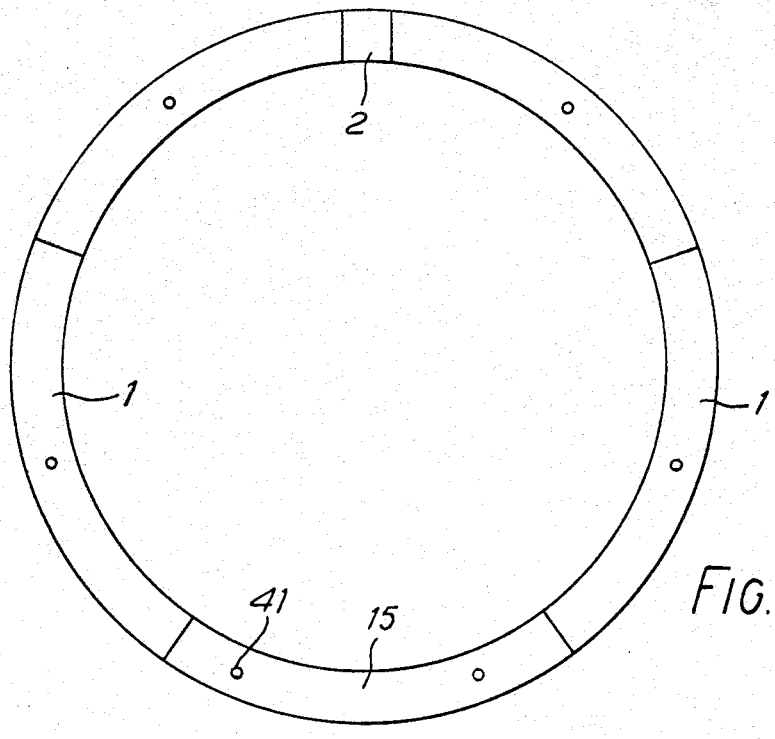
Figure 2:
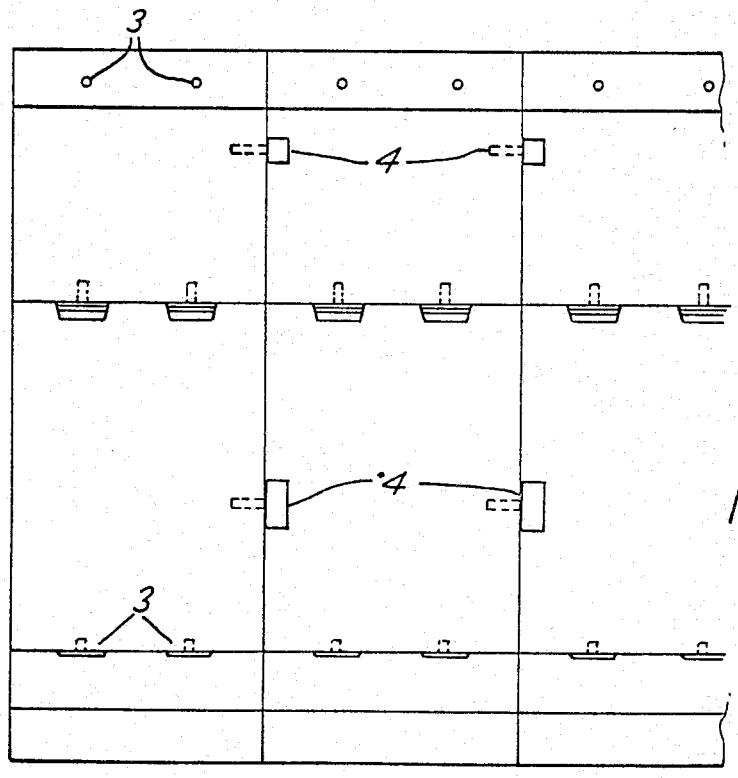
Figure 3:
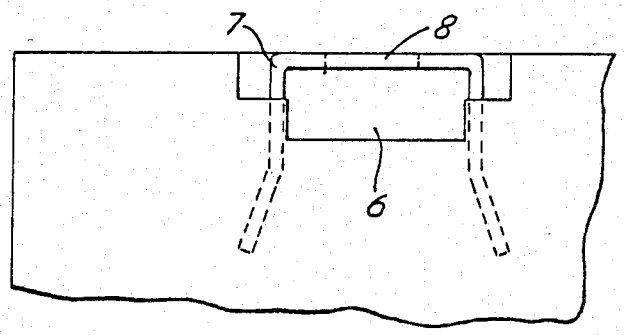
Figure 4:
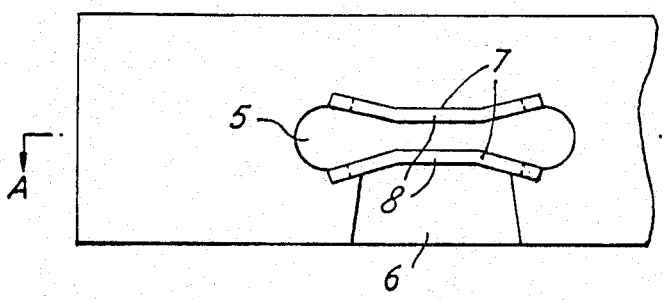
Figure 5:
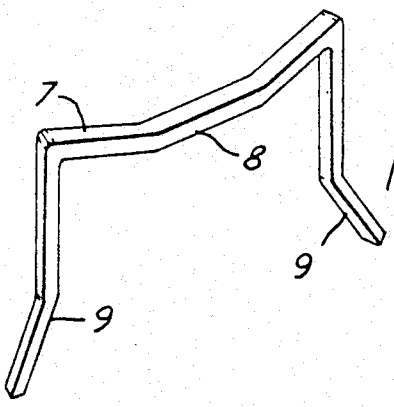
Figure 6:
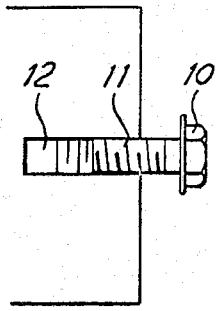
Figure 7:
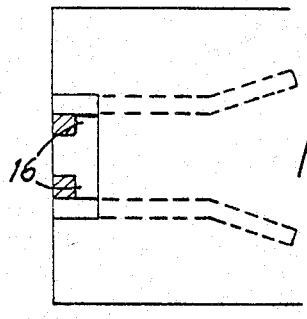
Figure 8:
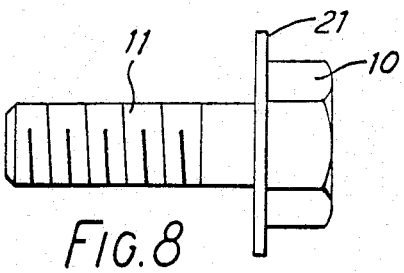
Figure 9:
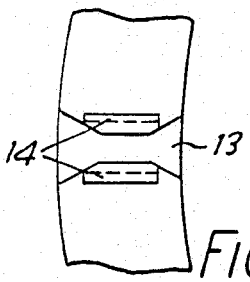
Figure 10:
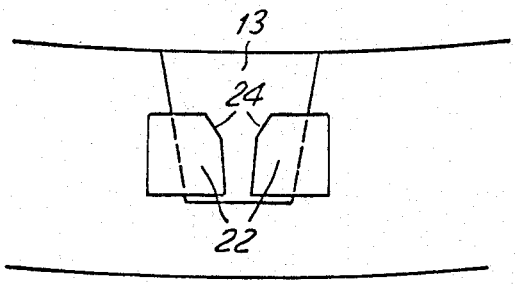
Figure 11:
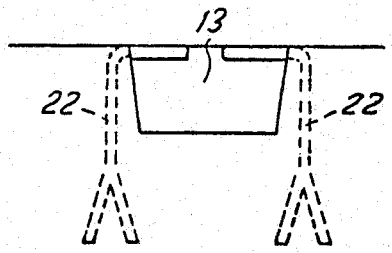
Figure 12:
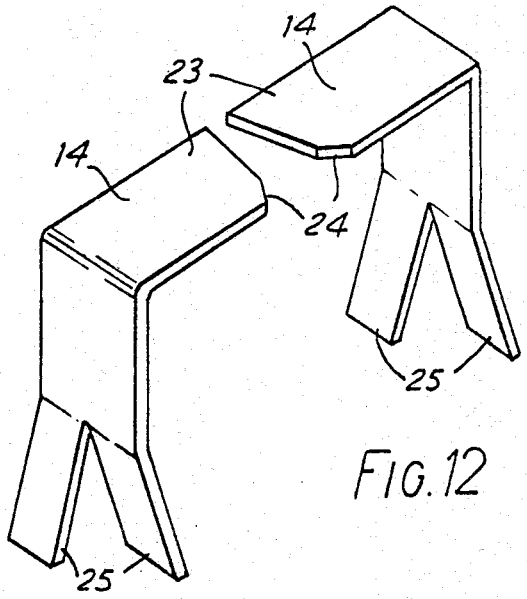
Figure 13:
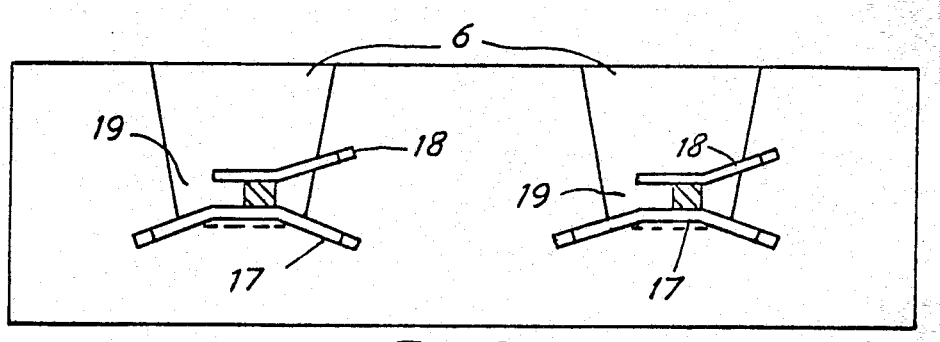
Figure 14:
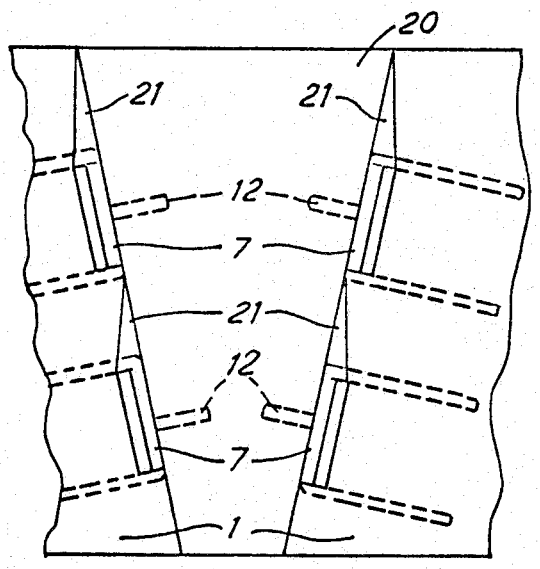
Figure 15:
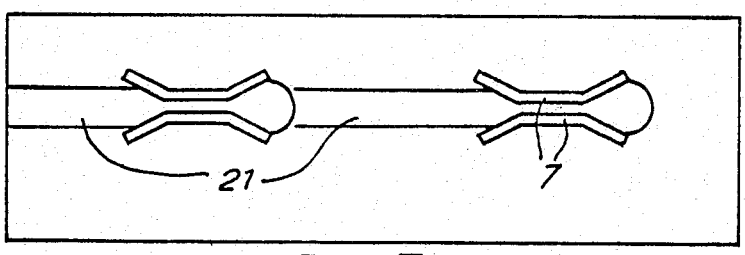
Figure 16:
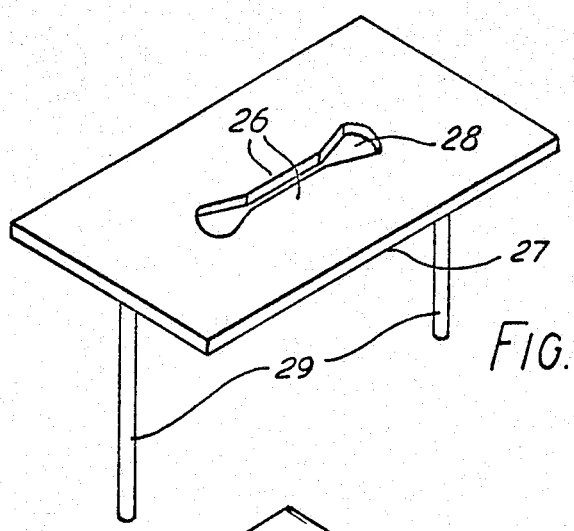

A method of assembling a tunnel lining according to the invention will be described by way of example with reference to the accompanying drawings in which:

FIG. 1 is a section of an annulus for a tunnel lining,

FIG. 2 is a section perpendicular to FIG. 1 of a tunnel lining formed of the annuli of FIG. 1, FIGS. 3 and 4 are perpendicular sections of a recess in an endge of a segment forming part of the annulus of FIG. 1, FIG. 5 shows an insert used in the annulus of FIG. 1, FIG. 6 is a section of a bolt and socket in an edge of a segment forming part of the annulus of FIG. 1, FIG. 7 is a section of the recess shown in FIGS. 3 and 4, FIG. 8 is a section of a bolt used in the segment of FIG. 6, FIG. 9 is a section of a segment showing a recess for joining the segment to a segment of an adjacent annulus, FIGS. 10 and 11 are perpendicular sections of a segment showing another type of recess for joining the segment to a segment of an adjacent annulus, FIG. 12 is a perspective view of a pair of inserts used in the recess of FIGS. 10 and 11, FIG. 13 is a section of recesses in an edge of a segment to abut the key segment of the annulus of FIG. 1, FIG. 14 is a section of another type of key segment and adjacent segments of an annulus similar to that of FIG. 1, FIG. 15 is a section of recesses in the edge of a segment adjacent the key of FIG. 14, and FIG. 16 is a perspective view of another type of pair of inserts for use in the recess of FIGS. 3 and 4.

Figure 17:
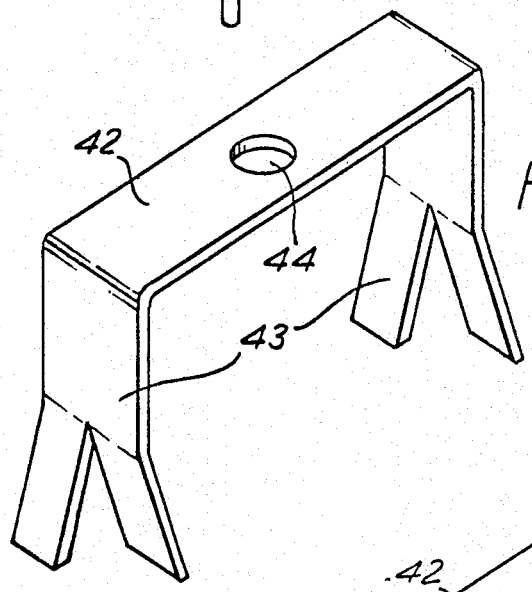
Figure 18:
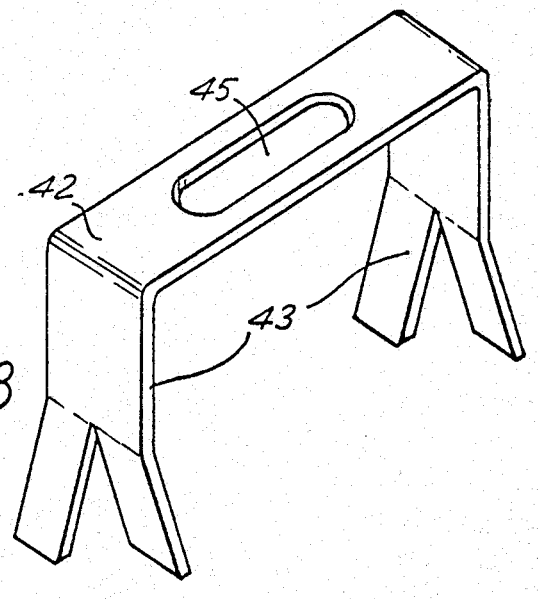

FIGS. 17 and 18 are perspective views of other types of inserts for use in the leading edges of the segments of FIG. 1.

As shown in FIG. 1, an annulus for a tunnel lining is made up of concrete arcuate segments 1, an invert segment 15 and a key segment 2 joined together end-to-end. Adjacent annuli are joined together side-by-side to form a continuous watertight concrete lining for a tunnel as shown in FIG. 2.

The ends of adjacent segments of an annulus are joined together end-to-end by joints indicated generally by 3 in FIG. 2 and the annuli are joined together by joints 4.

The nature of joints 3 is shown in FIGS. 3 to 8. The edge of one of the adjacent segments is provided with a recess 5 which is elongated in the longitudinal direction of the tunnel lining and opens at 6 into the interior of the lining (FIGS. 3 and 4). The recess is provided with a pair of steel inserts 7, one of which is shown in FIG. 5, cast into the concrete of the segment. The inserts are shaped as shown so that the prongs 9, splayed out at an angle, anchor the insert firmly in the concrete. The centre portions of the bridge parts 8 are flush with the edge of the segment and project inwardly of the recess 5 to define a central constriction and a pair of abutment surfaces 16 (FIG. 7) facing inwardly of the recess capable of engaging and retaining a hexagonal head 10 of a threaded bolt 11 (FIG. 6) projecting from the edge of an adjacent segment. As shown in FIG. 8, the bolt is provided with a washer 21 to abut the surfaces 16.

Bolt 11 is engaged in an internally threaded socket 12 cast into the segment edge. After assembly of the annulus the bolt may be tightened so that its head clamps the washer 21 against the abutment surfaces 16, thus holding the adjacent segments together.

Joint 4 comprises a bolt and socket of the same type as that shown in FIG. 6 in the side edge of the one engaging segment. As shown in FIG. 9 the leading edge of the adjacent segment of the adjoining annulus is provided with a recess 13 which passes through the whole thickness of the segment and is provided with steel inserts 14 cast into the concrete. These inserts are of the type shown in FIG. 12 and define a constriction in the recess dimensioned to receive the bolt 11 of the adjacent segment. The bolt may be tightened against the inserts as for joints 3.

Each of the segments 1 of an annulus, as shown in FIGS. 1 and 2, is provided with two bolts and sockets at one end to abut an adjacent segment of the same annulus and with recesses 5 at the other end. The invert segment 15 has two recesses at both its ends and the key 2 has two bolts and sockets at both its ends. The side edge of each of the segments, to abut an adjacent annulus, are provided with a recess 13 on one side and a bolt and socket on the other. As shown in FIG. 1, the side edges of the invert segment are provided with two holes 41 to receive dowels to allow aligning of the invert segments of the adjacent annuli. The invert segments are provided with a joint 4 as for the other segments.

When a tunnel is being dug it is progressively lined with annuli composed of the above-described segments as the working face advances. When assembling an annulus the invert segment 15 is first lowered into position with its side edge abutting the side edge of the invert segment of the preceding annulus. The respective invert segments are aligned with each other by means of the dowels inserted in holes 41. The recess 13 is located in the leading edge of the annulus already installed and the bolt in the trailing edge of the invert segment of the new annulus is located in the constriction formed by inserts 14 when the segment 15 has been positioned correctly. Bolt 11 may then be tightened with the head 10 and washer 21 engaging the abutment surfaces 16 of the insert pairs to clamp the invert segments together.

Segments 1 may then be mounted in place, with their end edge carrying bolts engaging the end edge provided with recesses 5 of the invert segment and with their side edge carrying a bolt engaging the side edge containing a recess 13 of the corresponding segment of the preceding annulus. Initially the segment 1 being installed is slightly advanced towards the working face of the tunnel and its upper end is tilted radially inwardly with respect to the preceding annulus. The bolts in the edge abutting the invert segment are located in the forward ends of the recesses 5 of the insert segment. The segment being installed is then slid rearwardly so that the bolts enter the constrictions formed by inserts 7 and the bolt heads 10 can engage the abutment surfaces of the inserts. During this sliding the segment is still inclined radially inwardly. When the trailing edge of the segment abuts the corresponding segment of the preceding annulus the segment is tilted outwardly so that the bolt 11 on its trailing edge enters the recess 13 of the corresponding segment and enters the constriction behind the inserts 14. All the heads 10 may then be tightened against the inserts to hold the segment in place.

All the segments of the annulus are assembled together in like manner, a narrow gap being left to accommodate the key 2. The key has bolts projecting from both end edges and it is mounted in place with these bolts in recesses 6 of both the adjacent segments.

The key used to complete an annulus may be parallel-sided or tapered.

FIG. 13 shows the end edge of a segment 1 adjacent the key 2 for use when the key is parallel-sided, as shown in FIG. 1. This edge has two recesses opening at 6 into the interior of the annulus, each recess having a pair of inserts 17, 18 providing an abutment surface for a bolt head in the same manner as inserts 7. Insert 17 is of similar construction to inserts 7 but insert 18 is shorter, to provide a gap 19 through which a bolt may pass.

When the annulus is assembled the segments adjacent the key are arranged with the gaps 19 directed towards the leading edge of the annulus. The key is then inserted from within the annulus, into a position slightly forward of its final position, two bolts on the edges of the key passing through the respective gaps 19. From this position the key is moved rearwardly so that the bolts engage the abutment surfaces of inserts 17 and 18.

An alternative arrangement in which the key is tapered is shown in FIGS. 14 and 15. In this case the end edges of the segments 1 adjacent the key are tapered to fit the tapered edges of the key 20. The segment end edges are provided with two recesses and inserts identical to those of the other segments except that the recesses are extended at one end by slots 21 to receive the bolts protruding from the key and allow the key to be slid into the position shown in FIG. 14, the bolt heads passing along the slots 21 and coming into engagement with the abutment surfaces of the inserts 7.

When the whole annulus has been assembled in this manner all the bolts may be finally tightened to give a rigid annulus and the recesses 13 and 6 opening into the inside of the tunnel may be filled with concrete or other filling material to form a smooth inside surface of the tunnel lining.

FIGS. 10, 11 and 12 show another type of recess and inserts for joints 4. In this case the recess 13 does not extend through the full thickness of the segment and opens only into the interior of the annulus. Each insert 22 comprises a plate 23 forming the abutment surface for the bolt. Plates 23 have a bevelled corner 24 to facilitate insertion of the bolt and splayed prongs 25 to hold the inserts firmly in the concrete of the segment. This type of insert may be used in the recess joints 3 also.

FIG. 16 shows an alternative construction of insert which may be used in the recesses of joints 3. In this case the constriction is formed by portions 26 of a single plate 27 which has an aperture 28 wide enough at its ends to allow passage of the bolt and washer and narrower by portions 26 to form the constriction. When this type of insert is used the bolt heads and washers are passed through aperture 28 and moved into the constriction. Plate 27 is secured to its segment by prongs 29 cast into the segment.

In the embodiment shown in FIG. 1 the invert segment 15 is provided with holes on its leading and trailing edges to receive dowels for aligning the invert segments of adjoining annuli relative to each other and the bolts of joints 4 of the invert segments are then inserted in their sockets after the segments are mounted in place. It is possible to provide the other segments of the annulus with similar holes and dowels on their leading and trailing edges, the bolts similarly being inserted after positioning of the segments. FIGS. 17 and 18 show alternative types of inserts which may then be used for joints 4. These inserts comprise a plate 42 providing an abutment surface for the bolt head with prongs 43 having splayed-out ends to secure the insert in the concrete. The bolt passes through aperture 44 or 45, the latter being elongated to allow play in one direction. However, as the bolt is inserted after positioning of the segments with the aid of dowels there is no need to provide the aperture with a wider part allowing passage of a bolt head.

The annuli may be provided with grout holes and caulking grooves (not shown in the drawings) in conventional manner so that the whole lining may be rendered wateright and grouted solid after assembly.

In the above-described embodiments the end edges of the segments are provided with two joining devices and the edge of the segments with one device but it will be understood that any number of similar devices may be provided on these edges, depending on the strength of the lining required. The method of joining may be applied to tunnel or shaft linings of any diameter comprising annuli made up of any number of segments. Each segment may be positively clamped to all the segments with which it is in contact by the bolts and inserts so that the lining can withstand large internal hydrostatic pressures.

I claim:

1. A method of joining together arcuate concrete segments of a tunnel lining which comprises providing an edge of one segment with a recess accessible from the inside of the tunnel and a pair of abutment members projecting into the recess to define a constriction therein with the abutment members forming a pair of abutment surfaces facing inwardly of the constriction, providing an edge of an adjacent segment with a screw-threaded socket and a screw-threaded headed bolt in the socket projecting beyond said edge of the adjacent segment, positioning the segments edge-to-edge and inserting the bolt of the adjacent segment into the recess and moving the adjacent segment relative to said one segment thus moving the bolt to within the constriction, and tightening the bolt head in the socket to urge the bolt head against the abutment surfaces.

2. A method according to claim 1, in which the segments are adjoining segments of one annulus of the lining, the recess extends in the edge of said one segment in the longitudinal direction of the tunnel, and the bolt of the adjacent segment is inserted in the recess and the adjacent segment is moved in the longitudinal direction of the tunnel to move the bolt into the constriction.

3. A method according to claim 2, in which the edge of said one segment has at least two recesses each of which receives a bolt of the adjacent segment.

4. A method according to claim 1, 2, or 3, in which the segments are segments of adjoining annuli, the recess extends into the inside of the tunnel and the bolt of the adjacent segment is moved substantially radially from the inside of the tunnel into the recess and then into the constriction.

5. A method according to claim 4, in which the recess extending into the inside of the tunnel also extends to the outside of the tunnel.

6. A method according to claim 1, in which the pair of abutment members comprises a pair of inserts embedded in the concrete.

7. A method according to claim 6, in which the inserts comprise bridge parts substantially flush with the edge of the segment forming the constriction and prongs extending into the concrete of the segment.

8. A method according to claim 7, in which the segments are adjoining segments of one annulus and the inserts are formed of a single plate having an aperture having a wider part through which the bolt head may pass and a narrower part forming the constriction.

9. A method according to claim 1, in which the segments are joined together to form a complete annulus comprising an invert segment having at least one recess on both opposite edges, a key segment having at least one bolt on both opposite edges, and the segments between the invert segment and key segment have at least one recess on one edge and at least one bolt on the opposite edge.

10. A method according to claim 9, in which the invert segment has at least two holes on its opposite edges to engage invert segments of adjoining annuli, and providing the holes with dowels joining the holes of abutting edges of adjoining invert segments to align the invert segments together.

11. A method according to claim 9 or 10, in which the recesses in the edges of the segments adjacent the key segment extend into the inside of the tunnel and the bolts of the key segment are moved substantially radially from the inside of the tunnel into the recesses and then into the constrictions.

12. A method according to claim 9 or 10, in which the edges of the key segment are tapered in the longitudinal direction of the tunnel and the edges of the segments adjacent thereto are tapered to abut the edges of the key segment inserting and provided with longitudinal slots, and the key in the annulus by moving it in the longitudinal direction of the tunnel, the bolt heads moving along the slots into the recesses.

* * * * *